US005275108A

United States Patent [19]

Chernicky et al.

[11] Patent Number: 5,275,108

[45] Date of Patent: Jan. 4, 1994

[54] MATCH-GRADE RIFLE CARTRIDGE WITH IMPROVED COMPONENTS

[75] Inventors: Steven T. Chernicky, Bonsall, Calif.; Gene L. Harwood, St. Helens, Oreg.

[73] Assignee: Endowment Fund of the International Shooter Development Fund, Inc., Washington, D.C.

[21] Appl. No.: 912,073

[22] Filed: Jul. 8, 1992

Related U.S. Application Data

[62] Division of Ser. No. 572,495, Aug. 23, 1990, abandoned.

[51] Int. Cl.[5] ..... F42B 5/02

[52] U.S. Cl. ..... 102/439; 102/444; 102/501; 102/511; 102/529

[58] Field of Search ..... 102/430, 439, 444, 501, 102/511, 515, 516, 517, 524, 526, 529, 471; 252/56

[56] References Cited

U.S. PATENT DOCUMENTS

| | | | |
|---|---|---|---|
| 45,306 | 12/1864 | Allen | 102/430 |
| 204,298 | 5/1878 | Crooke . | |
| 245,994 | 8/1881 | Carr . | |
| 296,958 | 4/1884 | Hebler | 102/517 |
| 326,231 | 9/1885 | Manning . | |
| 343,269 | 6/1886 | Geiger . | |
| 376,728 | 1/1888 | Brown . | |
| 478,020 | 6/1892 | Pollard | 102/532 |
| 862,778 | 8/1907 | Williams . | |
| 1,072,880 | 9/1913 | Tewes . | |
| 1,107,519 | 8/1914 | Hoagland | 102/430 |
| 1,325,987 | 12/1919 | Hadfield | 102/501 |
| 1,327,378 | 1/1920 | Eickhoff . | |
| 1,732,211 | 10/1929 | Olin et al. . | |
| 1,895,207 | 6/1932 | Rinkel . | |
| 1,944,884 | 1/1934 | Gerlich . | |
| 2,805,624 | 9/1957 | Holmes et al. | 102/92.5 |
| 2,911,911 | 11/1959 | White | 102/439 |
| 2,953,816 | 9/1960 | Kidder | 18/55 |
| 3,053,185 | 9/1962 | Oberfell et al. | 102/95 |
| 3,234,877 | 2/1966 | Herter | 102/95 |
| 3,394,905 | 7/1968 | Rapp | 102/520 |
| 3,516,360 | 6/1970 | Lathrope et al. | 102/95 |
| 3,713,388 | 1/1973 | Pontoriero | 102/532 |
| 3,750,580 | 8/1973 | Nomura et al. | 102/42 C |
| 3,873,048 | 3/1975 | Platou | 244/3.1 |
| 4,109,581 | 8/1978 | Six | 102/92.1 |
| 4,328,750 | 5/1982 | Oberg et al. | 102/514 |
| 4,417,521 | 11/1983 | Dahlitz | 102/511 |
| 4,445,436 | 5/1984 | Rutten | 102/501 |
| 4,454,175 | 6/1984 | Martin | 102/511 |
| 4,465,883 | 8/1984 | Lopata et al. | 585/9 |
| 4,517,897 | 5/1985 | Kneubuhl | 102/439 |
| 4,710,280 | 12/1987 | Brilmyer et al. | 204/146 |
| 4,731,189 | 3/1988 | Gregg, Jr. | 252/23 |
| 4,782,758 | 11/1988 | Washburn | 102/434 |
| 4,811,666 | 3/1989 | Lutfy | 102/501 |

FOREIGN PATENT DOCUMENTS

| | | | |
|---|---|---|---|
| 57203 | 10/1936 | Norway | 102/532 |
| 10039 | of 1912 | United Kingdom | 102/430 |

OTHER PUBLICATIONS

"Lyman Reloading Handbook for Rifle, Pistol and Muzzle Loading", 45 Edition, 1970, p. 255.

"Ammo Test", *Target Gun*, May 1985, pp. 31–41, Jun. 1985 pp. 32–36, Jul. 1985 pp. 33–39.

*Primary Examiner*—Harold J. Tudor

*Attorney, Agent, or Firm*—Ostrager, Chong & Flaherty

[57] ABSTRACT

Aerodynamic cartridge and bullet combination in which the bullet is provided with a substantially smooth, edge-free contour, and a heel having rebated boat tail. An upright wall in the cartridge is attached to the boat tail by crimping. The cartridge houses a radially expandable wad which is arranged between the bullet and a propellant. The wad permits use of harder bullets than conventionally employed in ammunition by ensuring an effective gas seal between the propellant and bullet, and heel swage out or minimal heel deformation depending on wad configuration during burning of the propellant. Etches are provided in the bullet for receiving a long-chain polymeric lubricant coating which reduces leading in the rifle barrel.

4 Claims, 3 Drawing Sheets

MATCH-GRADE RIFLE CARTRIDGE WITH IMPROVED COMPONENTS

This is a divisional of copending application Ser. No. 07/572,495 filed on Aug. 23, 1990, now abandoned.

DESCRIPTION

1. Field of Invention

This invention generally relates to rifle ammunition for use in target shooting matches. In particular, it relates to a rimfire cartridge having improved target accuracy for use in, for example, .22" rimfire target rifles.

2. Background Art

The basic requirements for ammunition to be used in .22" rimfire target rifles are well known. The diameter of the cartridge must conform closely to the diameter of the rifle chamber. The variance of the bullet weight from cartridge to cartridge must be within acceptable tolerances. Also the ignition system of the cartridge must be designed to fire when struck on the rim by the rifle striker with a force of about 0.15 foot pounds.

Further, the metal of the cartridge rim must deform rapidly upon striker impact in order to ignite the priming charge in the cartridge. However, the thickness and hardness of the metal must also be such that the striker does not pierce the rim.

In addition, the priming composition in the cartridge must first ignite without fail upon striker impact and initiate the burning of the propellant. It is crucial that the priming have a reproducible ignition, that is, that the priming in each cartridge produce the same amount of hot gas during the same short period of time when ignited.

The priming burns very rapidly, producing hot gases and particles which ignite the propellant. The propellant in turn burns rapidly, producing hot gases that result in a sudden rise in pressure inside the cartridge case. When the force on the bottom surface of the bullet exceeds the force with which the bullet is being held in the cartridge, the bullet is propelled out of the case mouth. As this happens, the diameter of the bullet heel must increase to prevent leakage of gas past the bullet during travel of the bullet in the rifle barrel.

The general principle of production of conventional rimfire cartridges will now be described with reference to FIG. 1. Initially a disk is stamped out of a sheet of metal. Then the disk is passed through a set of deep drawing dies to form the conventional case having a head 2, a rim 4, a wall 6 and a mouth 8.

At this stage in the manufacturing process the head must have uniform thickness. Also the rim must be precisely formed such that the primer flows into the rim cavity, where it will be ignited when the rim is struck by the firing pin. The case must be slightly bell mouthed.

The underhead position 10 is a flange which seats on the breech face of the rifle barrel.

After formation of the case, the case is charged with first priming compound 12 and then propellant 14. The primer is introduced in liquid, paste or powder form and forced into the rim cavity. An exact amount of propellant is thereafter loaded into the case.

The primer must be a substance that is very volatile when in a dry state. In particular, the primer must ignite spontaneously around the entire circumference of the rim cavity in order to ignite the propellant evenly and rapidly. Both the primer and the propellant must be manufactured under extremely well controlled conditions since any variation of the composition or the humidity in the manufacturing environment will produce corresponding variations in performance, thereby degrading the accuracy, that is, predictability, of the bullet flight.

Some conventional propellants are powders made from the basic ingredient nitrocellulose, to which is added nitroglycerine and other components. These materials are compounded into a plastic "dough" by the addition of solvents in a special mixer. The dough is then extruded through dies to produce a spaghetti-like strand which is cut by a machine into thin round flakes. The flakes may then be coated with a material to help control the burn rate and glazed with 0.1% of powdered graphite to make it flow readily in loading machines and to ground static electricity.

The bullet 16 is formed by swaging a workpiece made of lead into shape in a die. That shape is designed to overcome variances in wind conditions. In particular, the bullet must have aerodynamic properties allowing a stable and true flight at translational speeds of about 1060 ft/sec and rotational speeds of about 50,000 rpm. If the surface of the bullet has any defect or damage, the aerodynamics of the bullet in flight will deviate from the norm. Minor damage to the nose 22 or ogive 24 will not affect the bullet flight as much as damage in the area of the body 26. The latter will cause imperfect spin of the bullet and increasing yaw during flight.

Most conventional .22 caliber bullets use antimony as a lead hardening agent because of its low cost. However, because antimony and lead do not form a true alloy, bullets with antimony have inherent problems. The antimony often settles out when mixed and molded prior to wire extrusion and bullet making, thus causing poor uniformity of hardness. These conventional bullets are also subject to erratic hardening due to a process called "precipitation hardening". The hardness of antimony-lead bullets is not only a function of the composition, but also the melt temperature and quench rate in the mold. Further the hardness of antimony and lead compounds also decreases with age, which softening process is more pronounced at higher storage temperatures. Also an antimony-lead bullet is abrasive, which causes more fouling of the barrel with lead. All of the foregoing adds up to poor uniformity of the bullet hardness which is very detrimental to bullet accuracy.

After the propellant has been loaded, the bullet 16 is pressed into the case mouth. The bullet and case mouth are then cannelured by a machine which turns the bell mouth inwards to securely couple the bullet to the case. The crimped case mouth engages a circumferential groove, that is, cannelure 18, formed on the external surface of the heel 28 of the bullet 16.

The amount of force required to pull the bullet longitudinally out of the case is known as the "bullet pull". It is crucial that the bullet pull vary as little as possible from one cartridge to the next. If the bullet is not held firmly enough, it may be prematurely propelled down the barrel before the required pressure has built up behind it.

After the bullet has been secured to the case, the bullet is dipped in liquid lubricant. After the bullet is removed from the bath, the excess liquid drips off, leaving a thin film of lubricant on the bullet surface with extra lubricant accumulated in the knurls 20. The lubricant is also very important for accurate shooting. If the bullet were not coated with lubricant, then lead would be removed from the circumference as the bullet traveled down the barrel. It is desirable that lubricant deposits are formed on the surface of the barrel as each bullet passes, which deposits facilitate the travel of the subsequently fired bullets.

The heel 28 of the conventional bullet has a domed recess 30 arranged symmetrically with respect to the bullet axis. When the bullet is fired, the heel expands radially out to the barrel surface. The alignment of the bullet in the barrel depends on a perfectly axi-symmetrical radial expansion of the heel. Thus conventional .22 caliber bullets have the disadvantage that unsymmetrical radial expansion of the bullet heel is detrimental to accuracy.

Conventional .22 caliber bullets are made of soft lead having a hardness of 6–8 BHN. The use of soft lead bullets is disadvantageous because it deforms and slumps upon firing, which is deleterious to accuracy. Also as previously mentioned, .22 caliber bullets with antimony added to the lead suffer from nonuniformity of the bullet hardness, which again adversely affects the bullet accuracy.

The conventional .22 caliber bullet has a shape with a leading edge shoulder. This configuration is disadvantageous because leading edge shoulders on bullets greatly degrade bullet accuracy in the subsonic flight envelope due to shock waves created at the shoulder's edge. These shock waves may not be symmetrical.

Accordingly, it is a broad object of the present invention is to overcome the aforementioned disadvantages of conventional .22 caliber ammunition.

Another object of the invention is to provide .22 caliber ammunition which has greater accuracy than conventional .22 caliber ammunition and which can be used in target shooting.

Another object of the invention is to provide a .22 caliber bullet which has less radial expansion of the heel during firing than conventional .22 caliber bullets.

Another object of the invention is to provide a .22 caliber bullet which has a hardness greater than that of lead and more uniform than that of antimony-lead compounds.

Another object of the invention is to provide a .22 caliber bullet which has a shape that does not produce shock waves during sub-sonic flight.

Another object of the invention is to provide a .22 caliber bullet which has reduced wind drift during flight as compared to conventional .22 caliber bullets.

A further object of the invention is to provide a .22 caliber bullet which has reduced drag at subsonic velocities as compared to conventional .22 caliber bullets.

Another object of the invention is to provide a .22 caliber bullet which does not have the bullet slump inherent in conventional .22 caliber bullets.

Yet another object of the invention is to provide a .22 caliber bullet which has improved uniformity of the crimping as compared to conventional .22 caliber bullets.

Another object of the invention is to provide a .22 caliber bullet which has reduced leading of the barrel as the bullet passes therethrough as compared to conventional .22 caliber bullets.

It is still another object of the invention to provide .22 caliber ammunition with improved ignition as compared to conventional .22 caliber ammunition.

Yet another object of the invention is to provide an improved lubricant that has good high-temperature stability and no creepage and is easily removable from the barrel with common bore cleaning solvents.

A further object of the invention is to provide a device for ensuring a good gas seal between the bullet and propellant, which in turn prevents gas blow-by, improves powder burn uniformity and improves ignition and performance.

It is another object of the invention to eliminate the distortion to the bullet caused by forming circumferential grooves for holding lubricant on the bullet surface.

Finally, although the disclosed preferred embodiments of the invention are .22 caliber rimfire cartridges, it is the object of the invention to apply the teachings of the invention to rimfire cartridges of other calibers as well as to centerfire cartridges of all calibers.

DISCLOSURE OF THE INVENTION

In the present invention, these objects, as well as others which will be apparent from the description, are achieved generally by providing a cartridge and bullet of improved aerodynamic configurations, the bullet being made of a tin-lead alloy. The bullet is designed to have a shape wherein leading edge shoulders have been eliminated. In a preferred embodiment, the heel has the shape of a rebated boat tail to which the case is lightly crimped. The surface of the bullet, including the heel, has pockets for lubricant etched thereon. Preferred embodiments of the invention, employ .22 caliber bullets having a weight greater than that of conventional .22 caliber bullets.

Further, the cartridge of the invention has a radially expandable wad arranged between the bullet and propellant. This wad allows the use of harder bullets by ensuring an effective gas seal between the propellant and bullet during burning of the propellant. In the preferred rebated boat tail embodiment of the invention, the wad is fabricated of a shock absorbent material which limits heel deformation or swage out in the bullet. The cartridge also incorporates a novel lubricant that greatly reduces leading of the rifle barrel, such lubricant including a long-chain polymeric material. An effective application of the lubricant is obtained through provision of etched pockets in the exterior bullet surface.

Other objects, features and advantages of the present invention will be apparent when the detailed description of the preferred embodiments of the invention are considered in conjunction with the drawings. The drawings should be construed in an illustrative and not limiting sense as follows:

BEST MODE OF CARRYING OUT THE INVENTION

Figure 2:
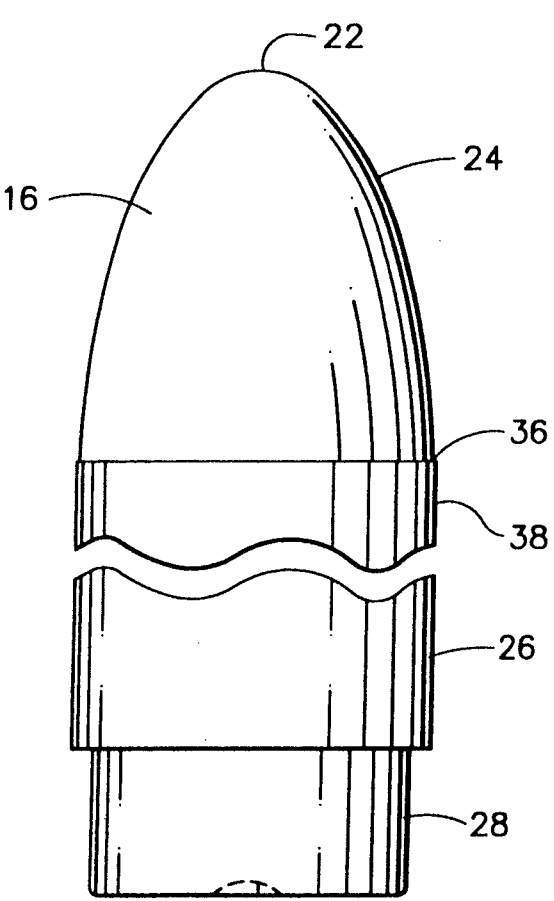
FIG. 2 is a side view showing the bullet shape in accordance with a preferred embodiment of the invention.
Figure 1:
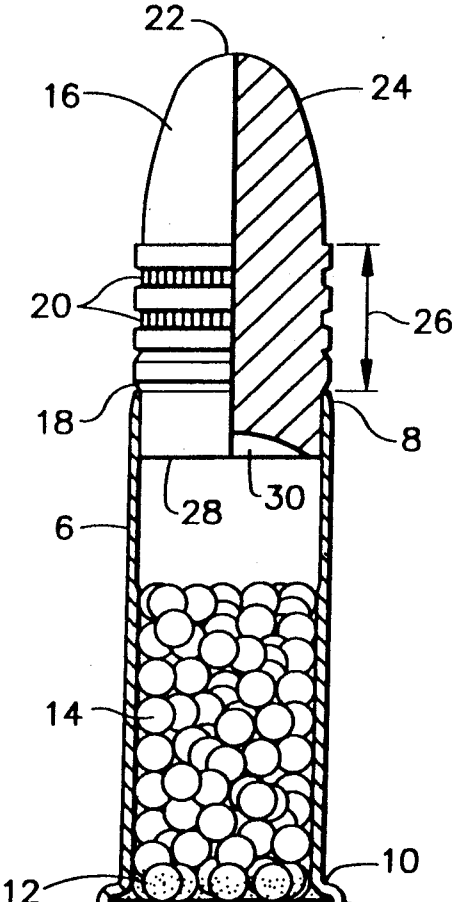
FIG. 1 (PRIOR ART)
FIG. 1 is a partial sectional view of a conventional .22 caliber cartridge.

In accordance with the first preferred embodiment of the invention, the bullet 16 has the profile shown in FIG. 2. The round nose 22 has a ½ caliber and the ogive 24 has a caliber of 2.0. The body 26 and the heel 28 are both substantially cylindrical. These cylindrical sections are concentric. In the case of a .22 caliber cartridge, the body has a diameter of 0.2240" and the heel has a diameter less than the body diameter, for example, 0.2082". The base surface of heel 28 lies in a radial plane and has an axially symmetric recess 32 formed therein. Recess 32 has the shape of a spherical section of radius 0.062" and a depth of 0.015". These dimensions are merely exemplary, however, and the use of other values for these dimensions would be within the scope of the invention.

Figure 5A:
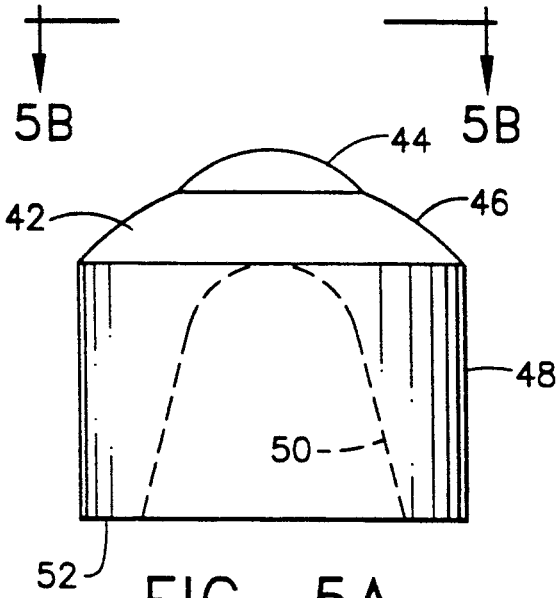
FIG. 5A is a side view of an expandable wad in accordance with a preferred embodiment of the invention.
Figure 5B:
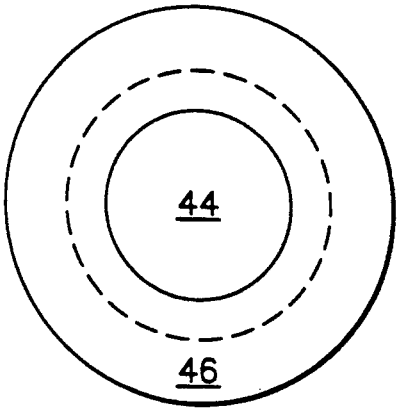
FIG. 5B is a top view of the wad depicted in FIG. 5A.

The recess 32 in the flat base surface of heel 28 is designed to interface with a small dome 44 formed as part of wad 42 depicted in FIGS. 5A and 5B. The function of the recess 32 is to couple with dome 44 to maintain the wad in axial alignment inside case 54 (see FIG. 6). The structure and function of the wad will be described in detail below.

As illustrated by the first preferred embodiment, it is a feature of the invention that the leading edge 36 of the bearing surface 38 is entirely removed either during the operation cf texturing the bullet surface or during travel of the bullet down the rifle barrel. Reduction in the height of the leading edge to substantially zero, effectively eliminates shock waves conventionally generated at the ogive-body interface during higher-velocity flight of the bullet. Initially the bearing surface can have a leading edge which is a few thousandths of an inch in height, which will be reduced to substantially zero by the time the bullet exits the rifle muzzle either during bullet texturing or travel of the bullet down the rifle barrel.

Figure 3:
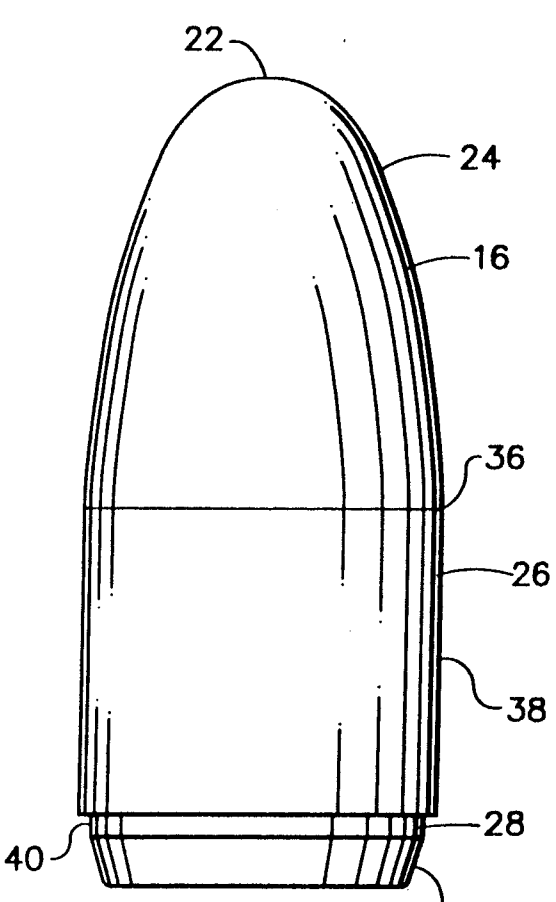
FIG. 3 is a side view showing the bullet shape in accordance with another preferred embodiment of the invention.

In accordance with the second preferred embodiment of the invention, the bullet 16 has the profile shown in FIG. 3. Again the round nose 22 has a ½ caliber and the ogive 24 has a caliber of 2.0. Also the body 26 is substantially cylindrical and has substantially no leading edge when it exits the muzzle of the rifle. Again the nose, body and heel are concentric. However, the heel 28 of the second preferred embodiment differs in structure from that of the first preferred embodiment. Heel 28 of the second embodiment is configured in the form of a rebated boat tail. The solid mass of the heel comprises a first portion 40 which has a substantially circular cylindrical surface and a second portion 34, that is, a rebated portion, which has a substantially conical surface. The conical surface of the rebated portion 34 of heel 28 has an angle of approximately 10 degrees.

Use of a rebated boat tail heel dramatically reduces the amount of drag on the bullet at subsonic velocities, which in turn reduces the amount of wind drift during flight of the bullet. The amount of drag reduction relative to a bullet without a boat tail-shaped heel is 15% at Mach 0.95, 25% at Mach 0.90 and 30% at Mach 0.80.

Because the drag reduction is dependent on the boat tail shape of the heel, it is important that the boat tail shape be only minimally altered by deformation of the heel during firing. If the case is to be crimped onto the heel for positive bullet retention, the crimping should be uniform around the heel circumference and impart the minimal amount of pressure on the heel that is sufficient to produce the desired amount of bullet pull. Also a powder should be used that produces a rise in pressure which is sufficiently slow that the boat tail shape is not deformed during firing, yet which still provides good accuracy, repeatable velocity and clean burn.

In addition, the deformation of the heel, as well as the deformation of the remainder of the bullet, is reduced by the use of a material which is harder than the material used in conventional bullets. For example, conventional .22 caliber ammunition has soft lead bullets of hardness 6 to 8 BHN. Such bullets deform and slump somewhat during firing, which is deleterious to bullet accuracy. Deformation in bullets yields asymmetrical aerodynamic properties in flight, and as a result, transverse force components act on the bullet mass to produce transverse displacements. This increases the divergence of the bullets from the target.

Bullet hardness is a very critical variable which effects several critical parameters of ammunition performance, including the following: nose slump, rear end swage out of the heel (flat base, not boat tail heels), crimp uniformity and bullet pull force, bullet engraving force when fired, and pressure and velocity. In accordance with the invention, a harder tin-lead alloy bullet is employed which ensures that the symmetry and balance of the bullet are retained after firing. Such uniformity in symmetry reduces adverse effects which attend deformation of the heel and other parts of the bullets, that is, increased drag and decreased accuracy.

Conventional .22 caliber ammunition designs use pure lead or lead-antimony compounds having a hardness in the range 4.8 to 8.5 BHN. Most conventional .22 caliber ammunition uses antimony as a lead hardening agent because of its low cost. However, the use of antimony has inherent problems because antimony and lead do not form a true alloy. The antimony often settles out when mixed and molded prior to wire extrusion and bullet making, thus causing poor uniformity of hardness. Antimony is also subject to erratic hardening due to a process called "precipitation hardening". In addition, the hardness of antimony-lead compounds can change over time and in response to changes in temperature. Hardness decreases with age and this softening is more pronounced at higher storage temperatures. Further, tests conducted to determine the effect of quench hardening 3% antimony-lead compounds in water demonstrate that hardness is a function of not only composition, but also melt temperature and quench rate in the mold. Up to a hardness of 35 BHN, this process was neither stable nor repeatable. All of these factors contribute to poor uniformity of bullet hardness which is very detrimental to accuracy. In addition, antimony-lead compounds are abrasive and lead to fouling of the rifle barrel.

To eliminate the foregoing disadvantages of the prior art, a 9% tin-91% lead alloy is employed in the preferred embodiments of the invention. A bullet with this composition has a hardness of about 10.2 BHN. This increase in hardness produces a concomitant decrease in deformation during firing. This major improvement is realized with only a modest increase in material cost.

Figure 4:
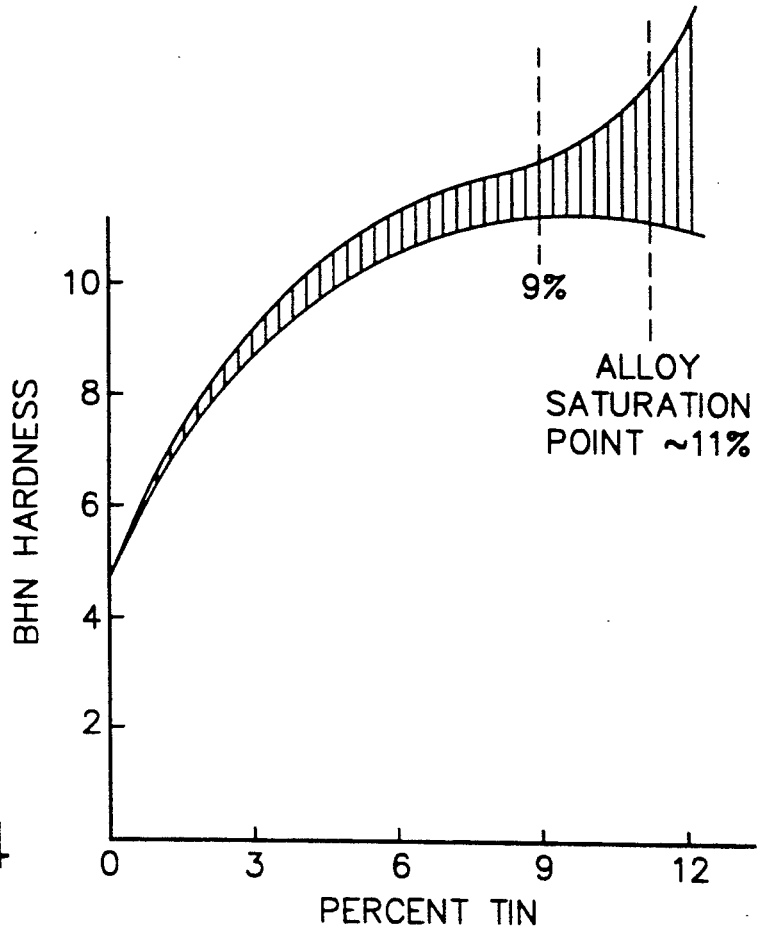
FIG. 4 is a graph showing the variation of the BHN hardness of the tin/lead alloy with tin percentage in accordance with the invention.

FIG. 4 is a graph of the variation in bullet hardness as a function of the percentage of tin in the tin-lead alloy of the invention. The mixture of tin and lead forms a true alloy up to a tin concentration of approximately 11%. Although the preferred embodiments of the invention have a tin content of 9%, bullets having a tin content in the range of 5 to 11% also have satisfactory hardness. The result is a very uniform and repeatable alloy which is ideal for making high-accuracy bullets which have reduced deformation during firing. The tin-lead alloy of the invention is stable with age and has a hardness which varies only slightly when small errors in the mixture of tin and lead are introduced. Tin also adds some lubricity to the bullet to reduce leading problems. Finally the tin-lead alloy of the invention enables better lot-to-lot crimp uniformity.

In addition, greater uniformity and repeatability of the hardness can be achieved using tin-lead alloys. The excellent uniformity and repeatability of hardness obtainable with tin-lead alloy also greatly improves the uniformity of any crimping operation, that is, decreases the variation from one round to the next.

FIGS. 5A, B and 8A, B, respectively, illustrate wad designs having application in the first and second embodiments of the invention. The wads 42, 42' have radially expandable designs which effect a good gas seal between the bullet and propellant upon ignition.

As shown in FIG. 5A, in accordance with the first preferred embodiment of the invention, the wad 42, which is preferably fabricated of a low density polyethylene, comprises a circular cylindrical section 48 of first radius integrally formed at a radial plane with a spherical section 46 of second radius greater than the first radius, and a spherical section 44 also integrally formed with spherical section 46 and having a third radius less than the first and second radii respectively. The section 48 has a base 52 in a radial plane which has a recess 50 extending therefrom. Recess 50 is axially symmetric and has a shape which has a conical and spherical sections, the juncture between the conical and spherical sections of recess 50 being substantially smooth.

In the case of a .22 caliber cartridge, the wad 42 has an axial length of 0.202" and a diameter of about 0.209". When the priming mixture is ignited, the pressure inside recess 50 increases dramatically. As the pressure increases, the front end of the wad is flattened out and the wad expands radially to the bore/groove diameter of about 0.222". Advantageously, the wad 42 on expansion mashes against the bullet heel effecting efficient transfer of energy and heel deformation required for bullet pull on ignition.

Figure 8A:
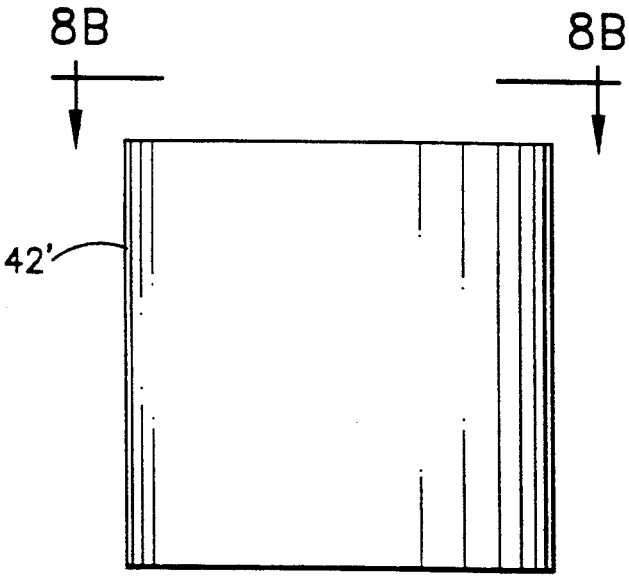
FIG. 8A is a side view of an expandible wad in accordance with another preferred embodiment of the invention.
Figure 8B:
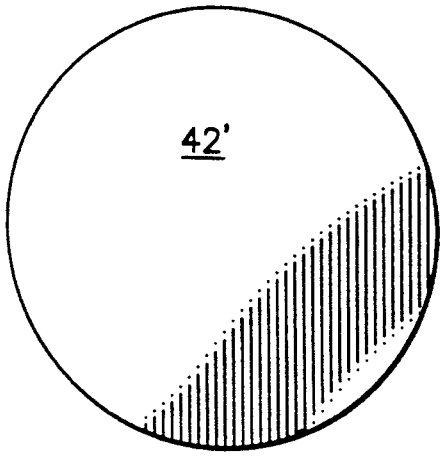
FIG. 8B is a top view of the wad depicted in FIG. 8A.

Referring to FIGS. 8A and B, the alternative wad embodiment, designated 42', has a circular cylindrical configuration of uniform radius having the specifications set forth above. The wad 42' is preferably fabricated of a foamed low density polyethylene offered under brand designation VOLARA by Sekisui America, Voltek Division, 100 Shepard Stree, Lawrence, Mass. 01843. Use of this design is particularly advantageous in the second boat tail bullet embodiment of the invention. See FIG. 3. The low density polyethylene wad functions to absorb shock as well ensure good gas seal of the bullet heel upon ignition. This shock absorption feature minimizes distortion and deformation or swage out during burning of the propellant.

The expanded wad 42, 42' stops gas blow-by, which removes or burns lubricant from the bullet surface and causes tipping (that is, yaw) of the bullet. A good gas seal also improves powder burn uniformity, thereby reducing variation in the bullet velocity. The wad also helps to confine the powder close to the priming mixture, thereby improving ignition and performance.

In addition, the polyethylene material making up the wad has good shape memory, which enables positive separation of the wad from the bullet after the bullet and wad exit from the rifle muzzle.

The wad is also beneficial in that it acts as a squeegee during travel down the barrel. This squeegee action wipes the inner surface of the rifle barrel, thereby maintaining very uniform initial conditions inside the barrel for each shot by leaving a uniform residue of lubricant and powder thereon.

The elimination of gas leakage past the bullet also allows the use of a much wider range of powders. A powder can then be selected which optimizes bullet velocity, and yet which is still comfortably above the powder threshold pressure to ensure uniform internal ballistics.

The expand-up wad also eliminates the need for a reduced bore size for the .22 caliber rimfire barrel. A reduced bore size has long been used to ensure rear end swage out of the bullet to maintain accuracy. The resulting bullet deformation from swaging the bullet down to a smaller diameter upon firing in fact degrades accuracy if the swage down is not perfectly axially symmetrical. This lack of axial symmetry is further degraded if the bullet is tipped by leakage of high-pressure gas past the bullet. The use of the expand-up wad eliminates both of these problems.

Another aspect of the invention is that for .22 caliber ammunition, the weight of the bullet in the preferred embodiment can be made greater than the conventional weight of 40 grains. This is accomplished by making the bullet longer and shortening the case to maintain the overall length of the cartridge. The heavier bullet results in a reduction in wind drift as compared to the conventional bullet. For weights of 45, 50 and 55 grains, the respective estimated reductions in wind drift are 8, 16 and 24%.

To achieve gyroscopic stability in flight of the bullet, the rifle barrel is provided with twisting for causing the traveling bullet to revolve axially when it exits the muzzle. For bullet weights of 45, 50 and 55 grains, the respective barrel twists should be roughly 15, 14 and 13 inches per turn.

Although the length of the bearing surface is increased for .22 caliber bullets heavier than 40 grains, a corresponding increase in the area of the bearing surface can be avoided by texturing the bearing surface. This reduces the actual area of frictional contact between the barrel while maintaining the increased axial length of the bearing surface/barrel contact. The textured surface holds the lubricant, thereby eliminating the need for lube grooves which can cause bullet distortion.

Figure 7:
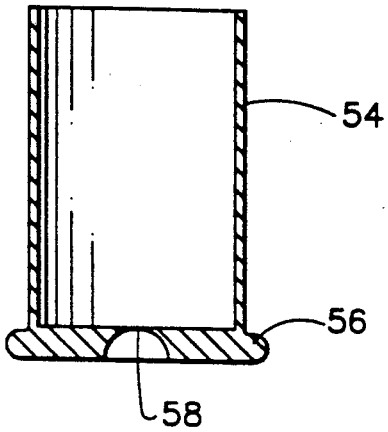
FIG. 7 is a side view showing a case with an indentation in the cartridge head used to improve the ignition characteristics of the .22 caliber cartridge.

In accordance with the invention, the case 54 (see FIG. 7) is provided with a spherical indentation 58 in the base which serves as a burn barrier to the explosive priming 56. This barrier creates a forward thrust blast shaped like a donut. This configuration will provide much more uniform powder ignition than obtained in conventional flat bottom constructions. Presently the preferred powders are Winchester ball powders which have been sieved to a small particle size range to allow accurate metering of the powder charge.

The crimping of the case onto the bullet can radically change the time pressure of the powder burn. Thus proper crimping is extremely important to performance as well as critical to uniformity.

In accordance with a preferred embodiment of the invention, positive bullet retention in the case is achieved using conventional roll crimping. Roll crimping offers repeatable and strong bullet retention or pull force and is fast and economical for production.

Figure 6:
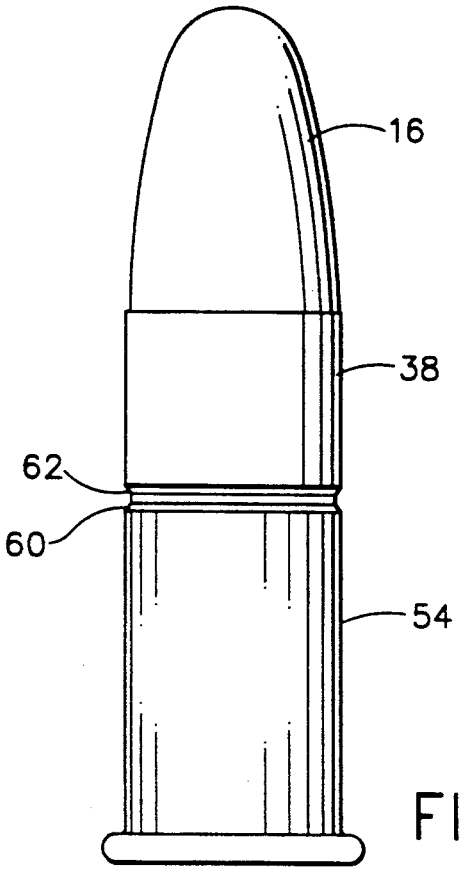
FIG. 6 is a side view showing the bullet crimp of the cartridge in accordance with the invention.

As depicted in FIG. 6, a light roll crimp 60 of the top of the case 54 along with a lock-in groove 62 formed on the bullet 16 slightly presses a ring of lead in contact with the case rim to hold the bullet snug. Any tractoring or grip ring should be applied to the case below the bullet edge to eliminate the possibility of bullet distortion.

Finally, in accordance with the invention, a new lubricant which greatly reduces leading is applied on the bullet, the entire surface of which, including the heel, is textured. This lubricant is a long-chain polymeric material which is held in the hundreds of pockets which make up the textured surface. In conventional ammunition, the bullet heel is not lubricated and becomes a source of leading when swaged out upon firing.

The texturing operation applies hundreds of lube pockets over the entire bullet surface with minimal distortion. This operation is accomplished by tumbling bullets for about 20 minutes in a 6-inch-diameter tumbler which is ¼ full of No. 16 metal grit and ¼ full of bullets. The No. 16 metal grit must be pre-sieved in No. 16 mesh screen to remove all small particles. The metal grit textures the bullet surface by impact and abrasion during tumbling. After texturing, the bullets are rinsed and dried in 99% isopropyl alcohol. The lubricant is thereafter applied to the surface of the bullets.

The lubricant in accordance with the invention has the following formula by weight: 1 part white beeswax (commercial grade); 2 parts Fluoro-SLIP 225 (available from Shamrock Chemicals Corporation, Newark, N.J.); 1 part pure lanolin (commercial grade); and 2 parts VIS-40 polymer lubricant (available from Shell Oil Company, Houston, Tex.). Fluoro-SLIP is a fluoroethylene polymer specially formulated to impart rub and slip properties to a variety of coatings. It is a white free-flowing powder having an initial melting point of 220° F. and a specific gravity of 1.12.

All of the components are melted while stirring at 275° F. (max.) until the solution becomes milky clear, then the solution is poured into molds and allowed to cool. The lubricant is applied by adding about two teaspoons of the lubricant in the form of small particles to a 6-inch-diameter tumbler which is half-filled with bullets. The bullets are then tumbled for about 10 minutes.

The above-described lubricant has good high-temperature stability (150° F.) for storage and handling and neither dries nor oxidizes with age. Also once applied to the bullet surface, no creepage of the lubricant occurs. In addition, the lubricant residue is easily removed from the rifle barrel with common bore cleaning solvents. Finally the lubricant virtually eliminates barrel leading.

Numerous modifications in the preferred embodiments are within the scope of this disclosure. For example, the preferred embodiments of the invention employ expandable wads 42, 4240 fabricated of polyethylene. It will be recognized that other natural and synthetic materials having like characteristics may be employed in the wad design. Similarly, those skilled in the art will appreciate that the lubricant formula may be varied from the preferred composition. Moreover, although a combination of all of the above-described features of the invention will give optimum accuracy, each feature alone is deemed to be novel and useful and capable of being used separately.

Therefore, although the invention has been described with reference to certain preferred embodiments, it will be appreciated that other closure structures may be devised, which are nevertheless within the scope and spirit of the invention as defined in the claims appended hereto.

We claim:

1. A .22 caliber rimfire rifle cartridge for use in high-accuracy target shooting, comprising:

a bullet made to metal material and comprising a rounded nose, a body integrally joined to said nose and a heel integrally joined to said body, said body having a bearing surface;

a metal case crimped onto said bullet and having a cavity;

priming material arranged in the bottom of said cavity;

propellant material arranged in said cavity above said priming material; and an axially symmetric radially expandable wad made of elastic material arranged in said cavity between said bullet and said propellant, said wad confining said propellant material closely to said priming material, wherein said bullet is made of lead alloy material having a hardness in excess of 9 BHN, said heel is in the shape of a rebated boat tail of concial section and said wad is made of an elastic shock-absorbent material, said shock-absorbent wad and said hardened bullet combining to ensure that said bullet exiting a muzzle of a rifle barrel will have improved aerodynamic properties and improved accuracy.

2. The cartridge as recited in claim 1, wherein said bullet is made of tin/lead alloy material having an amount of tin in the range of 5–11%.

3. The cartridge as recited in claim 1, wherein said heel has a rebated boat tail of substantially 10 degrees.

4. The cartridge as recited in claim 1, wherein said wad is made of polyethylene.

* * * * *